US006328066B1

(12) United States Patent
Blake

(10) Patent No.: US 6,328,066 B1
(45) Date of Patent: Dec. 11, 2001

(54) AUXILIARY FAUCET VALVE

(76) Inventor: Michael Blake, 1126 Mile Square Rd., Yonkers, NY (US) 10704

( * ) Notice: Subject to any disclaimer, the term of this patent is extended or adjusted under 35 U.S.C. 154(b) by 0 days.

(21) Appl. No.: 09/887,269

(22) Filed: Jun. 22, 2001

(51) Int. Cl.[7] ..... F17D 1/08
(52) U.S. Cl. ..... 137/613; 137/801; 137/377
(58) Field of Search ..... 137/613, 801, 137/377

(56) References Cited

U.S. PATENT DOCUMENTS

| | | | | |
|---|---|---|---|---|
| D. 299,520 | | 1/1989 | Pechler . | |
| 3,687,166 | | 8/1972 | Herrin . | |
| 3,790,966 | | 2/1974 | Keane . | |
| 4,508,130 | | 4/1985 | Studer et al. . | |
| 4,610,784 | * | 9/1986 | Reyniers | 210/169 |
| 5,173,178 | * | 12/1992 | Kawashima et al. | 137/801 X |
| 5,361,427 | * | 11/1994 | Wilk | 4/420.3 |
| 5,546,978 | | 8/1996 | Parker . | |
| 5,639,063 | | 6/1997 | Barker . | |

* cited by examiner

*Primary Examiner*—Kevin Lee

(57) ABSTRACT

An auxiliary faucet valve for shutting off the flow of water between an inlet pipe and a faucet. The auxiliary faucet valve includes a hose having a first end and a second end. The first end comprises a threaded female coupler for fluidly coupling to an inlet pipe. The second end comprises a threaded female coupler for fluidly coupling to a faucet. The hose is flexible. A valve is positioned between the first and second ends and is adapted for selectively opening and closing the hose.

5 Claims, 4 Drawing Sheets

AUXILIARY FAUCET VALVE

BACKGROUND OF THE INVENTION

1. Field of the Invention

The present invention relates to valve devices and more particularly pertains to a new auxiliary faucet valve for shutting off the flow of water between an inlet pipe and a faucet.

2. Description of the Prior Art

The use of valve devices is known in the prior art. More specifically, valve devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,508,130; 5,639,063; 5,546,978; 3,687,166; 3,790,966; and U.S. Des. Pat. No. 299,520.

While these devices fulfill their respective, particular objectives and requirements, the aforementioned patents do not disclose a new auxiliary faucet valve. The inventive device includes a hose having a first end and a second end. The first end comprises a threaded female coupler for fluidly coupling to an inlet pipe. The second end comprises a threaded female coupler for fluidly coupling to a faucet. The hose is flexible. A valve is positioned between the first and second ends and is adapted for selectively opening and closing the hose.

In these respects, the auxiliary faucet valve according to the present invention substantially departs from the conventional concepts and designs of the prior art, and in so doing provides an apparatus primarily developed for the purpose of shutting off the flow of water between an inlet pipe and a faucet.

SUMMARY OF THE INVENTION

In view of the foregoing disadvantages inherent in the known types of valve devices now present in the prior art, the present invention provides a new auxiliary faucet valve construction wherein the same can be utilized for shutting off the flow of water between an inlet pipe and a faucet.

The general purpose of the present invention, which will be described subsequently in greater detail, is to provide a new auxiliary faucet valve apparatus and method which has many of the advantages of the valve devices mentioned heretofore and many novel features that result in a new auxiliary faucet valve which is not anticipated, rendered obvious, suggested, or even implied by any of the prior art valve devices, either alone or in any combination thereof.

To attain this, the present invention generally comprises a hose having a first end and a second end. The first end comprises a threaded female coupler for fluidly coupling to an inlet pipe. The second end comprises a threaded female coupler for fluidly coupling to a faucet. The hose is flexible. A valve is positioned between the first and second ends and is adapted for selectively opening and closing the hose.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new auxiliary faucet valve apparatus and method which has many of the advantages of the valve devices mentioned heretofore and many novel features that result in a new auxiliary faucet valve which is not anticipated, rendered obvious, suggested, or even implied by any of the prior art valve devices, either alone or in any combination thereof.

It is another object of the present invention to provide a new auxiliary faucet valve which may be easily and efficiently manufactured and marketed.

It is a further object of the present invention to provide a new auxiliary faucet valve which is of a durable and reliable construction.

An even further object of the present invention is to provide a new auxiliary faucet valve which is susceptible of a low cost of manufacture with regard to both materials and labor, and which accordingly is then susceptible of low prices of sale to the consuming public, thereby making such auxiliary faucet valve economically available to the buying public.

Still yet another object of the present invention is to provide a new auxiliary faucet valve which provides in the apparatuses and methods of the prior art some of the advantages thereof, while simultaneously overcoming some of the disadvantages normally associated therewith.

Still another object of the present invention is to provide a new auxiliary faucet valve for shutting off the flow of water between an inlet pipe and a faucet.

Yet another object of the present invention is to provide a new auxiliary faucet valve which includes a hose having a first end and a second end. The first end comprises a threaded female coupler for fluidly coupling to an inlet pipe. The second end comprises a threaded female coupler for fluidly coupling to a faucet. The hose is flexible. A valve is positioned between the first and second ends and is adapted for selectively opening and closing the hose.

Still yet another object of the present invention is to provide a new auxiliary faucet valve that is retrofittable between a faucet and an inlet pipe for shutting off the water such that a faulty faucet may be changed. In this manner, the inlet pipe valve need not be relied upon for shutting off the water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
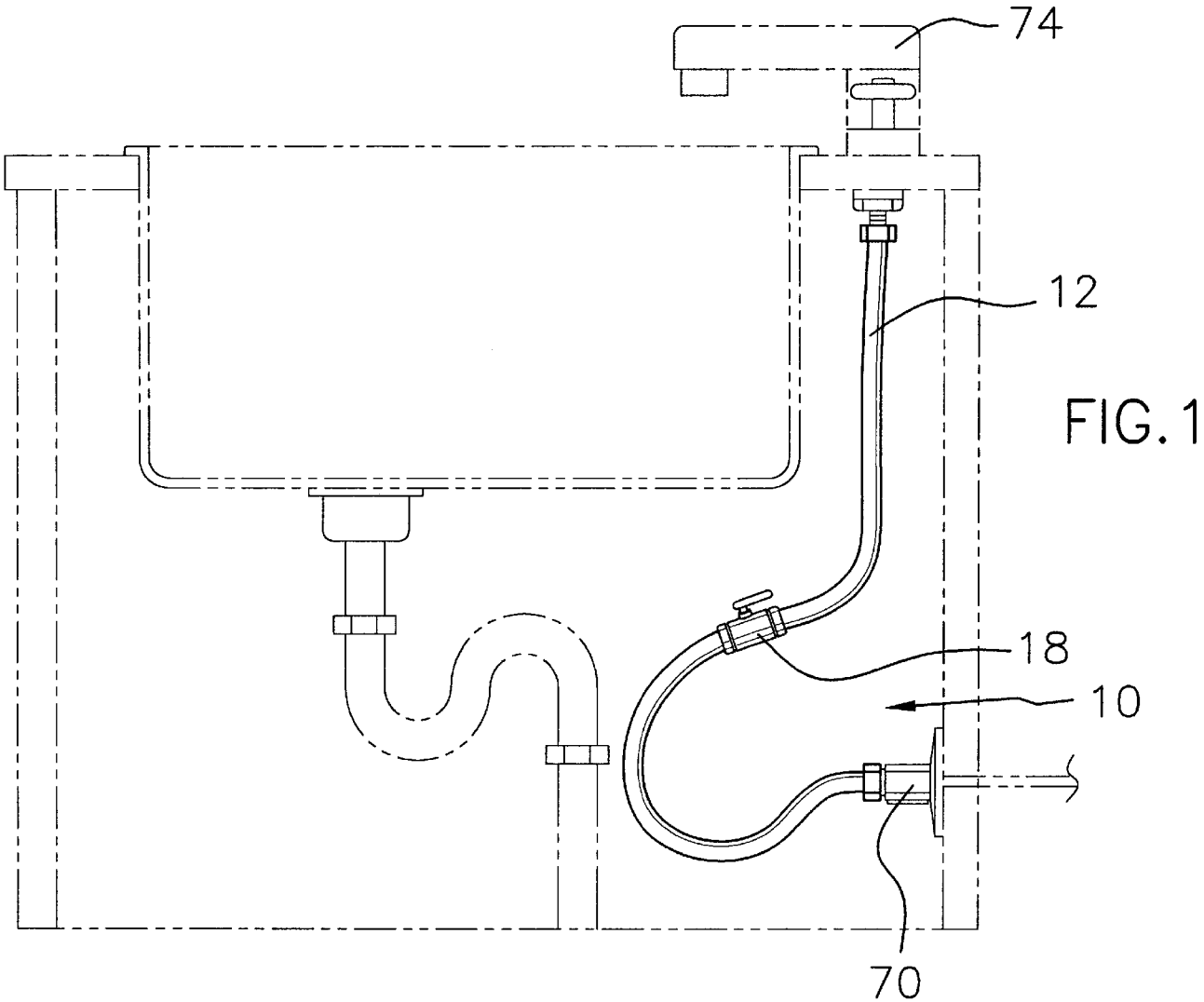
FIG. 1 is a schematic side view of a new auxiliary faucet valve according to the present invention.
Figure 2:
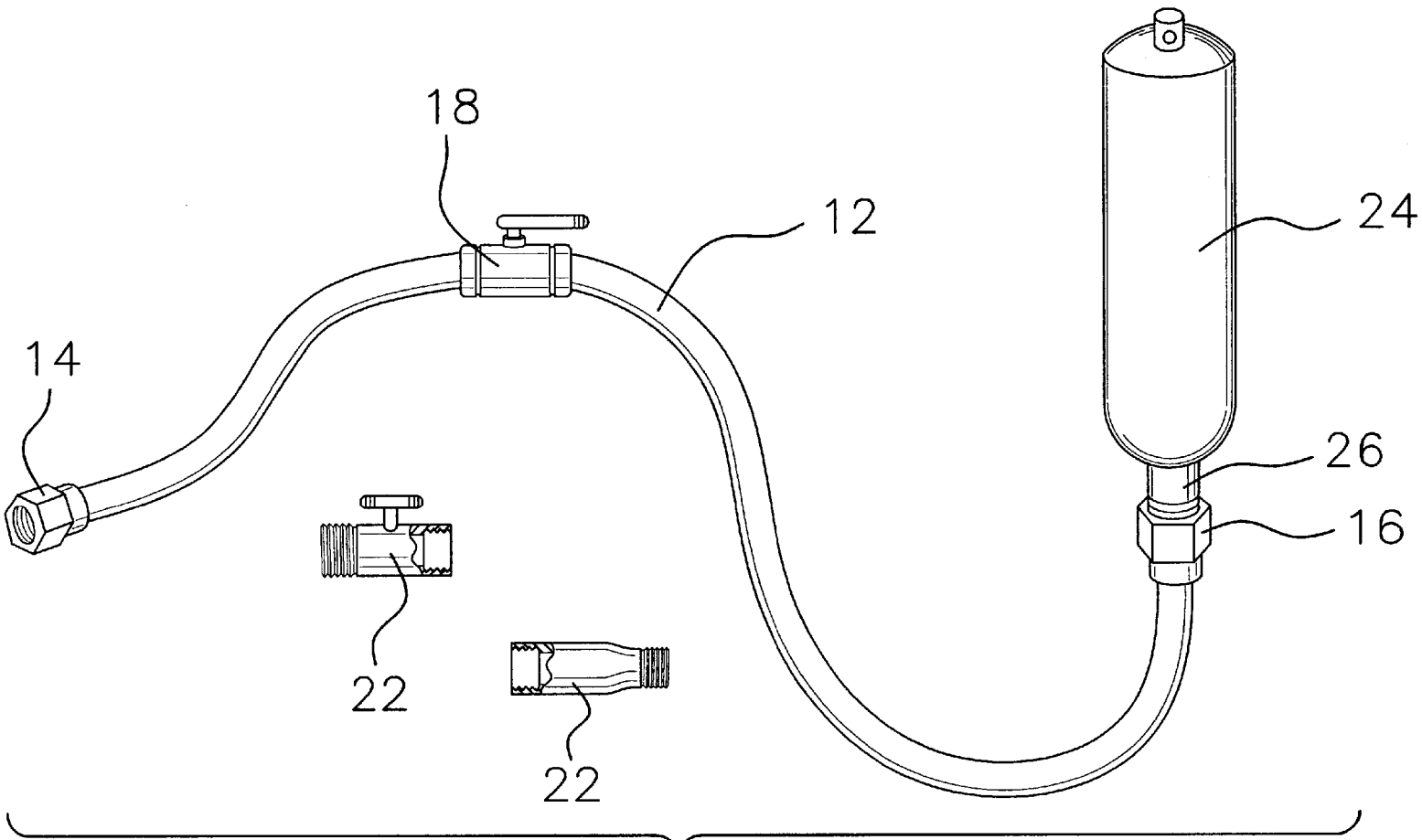
FIG. 2 is a schematic side view of the present invention.
Figure 3:
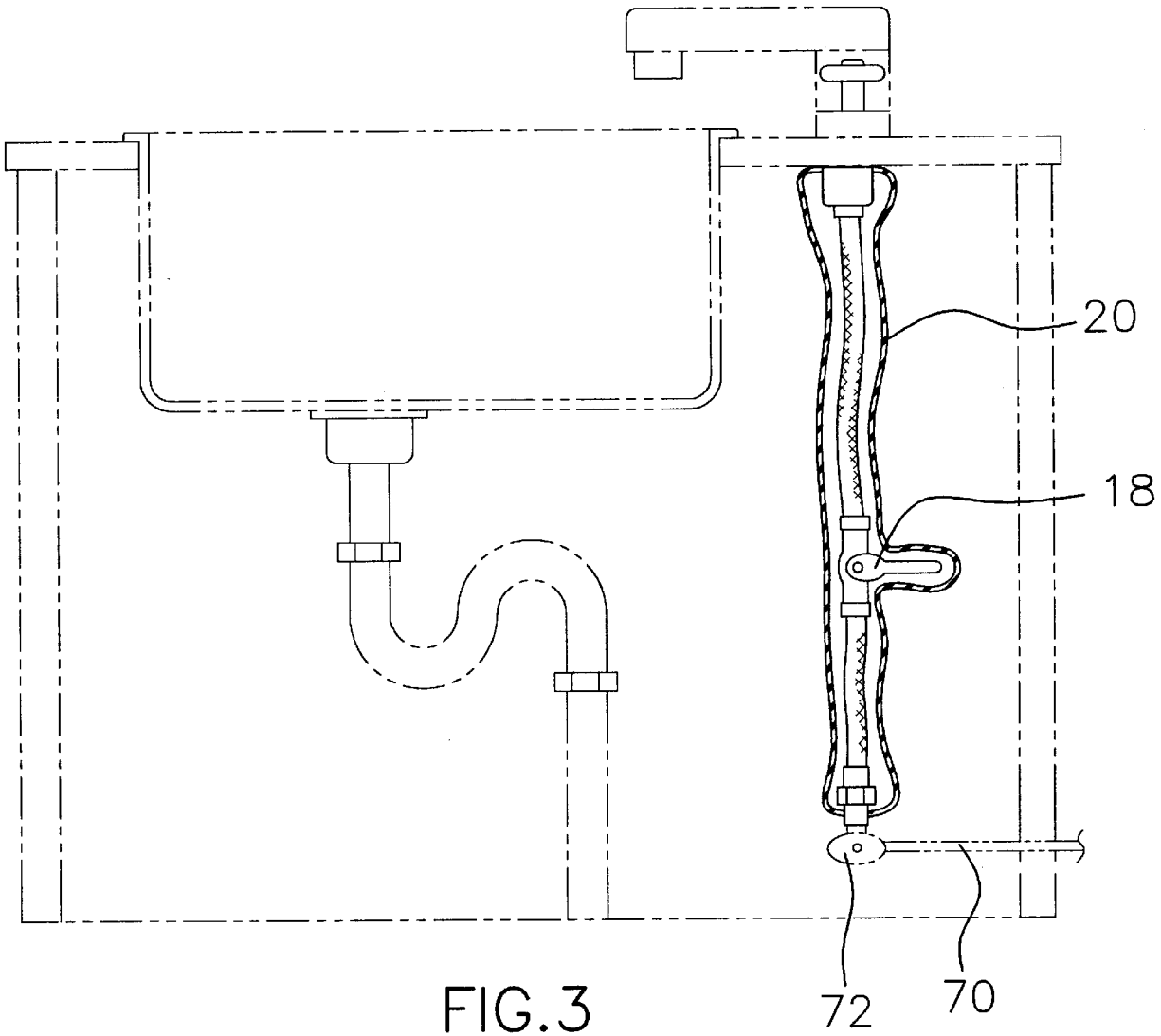
FIG. 3 is a schematic side view of the present invention.

With reference now to the drawings, and in particular to FIGS. 1 through 5 thereof, a new auxiliary faucet valve embodying the principles and concepts of the present invention and generally designated by the reference numeral 10 will be described.

As best illustrated in FIGS. 1 through 5, the auxiliary faucet valve 10 generally comprises a device for positioning an inlet pipe 70 in communication with a faucet 74. The device 10 comprises a hose 12 having a first end 14 and a second end 16. The first end 14 comprises a threaded female coupler for fluidly coupling to the inlet pipe 70. The first end 14 is preferably a ⅜ inch coupler. The second end 16 comprises a threaded female coupler for fluidly coupling to the faucet 74. The second end 16 is preferably a ½ inch coupler. The hose 12 is ideally flexible and has a length between 8 inches and 15 inches.

Figure 5:
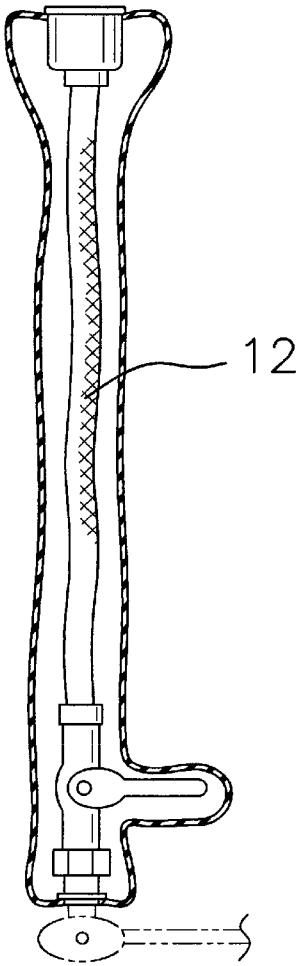
FIG. 5 is a schematic side view of the present invention.
Figure 4:
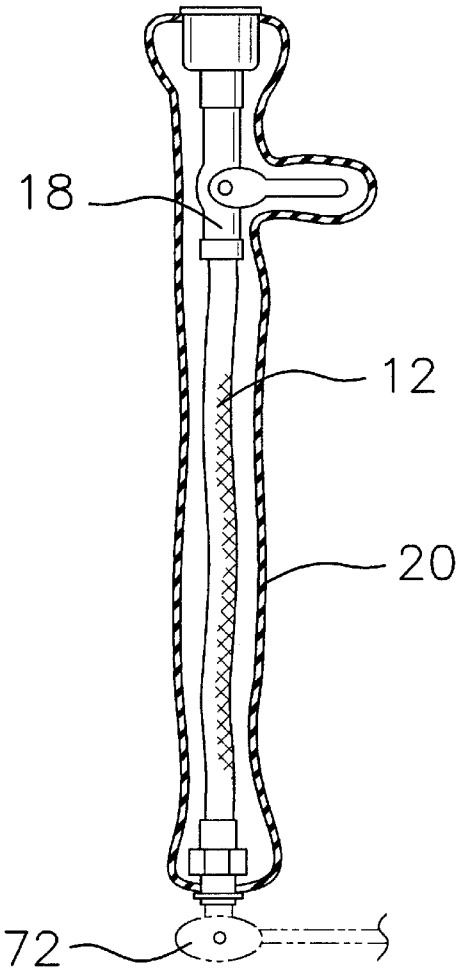
FIG. 4 is a schematic side view of the present invention.

A valve 18 is positioned between the first 14 and second 16 ends and is adapted for selectively opening and closing the hose 12. The valve 18 is a conventional valve and is preferably a ball valve. Additional couplers 22 and valves may be used to ensure a proper fitting to the faucet 74 or inlet pipe 70. The valve 18 may be positioned relatively closer to the first end 14 or the second end 16 as shown in FIGS. 4 and 5 for convenience purposes.

A sheath 20 is positioned around and generally encloses the hose 12 and the valve 18. The sheath 20 is flexible and substantially waterproof.

A bottle 24 has an open end having a male threaded 26 coupler thereon adapted for threadably coupling to the second end 16 of the hose 12.

In use, the device 10 is fluidly coupled to the inlet pipe 70 and the faucet 74. The valve 18 may be used to close the connection between the inlet pipe 14 and the faucet 74 should the inlet pipe valve 72 leak which often occurs. The valve 18 on the device 10 is used for changing a leaking faucet 74 without having to use the inlet pipe valve 72. The second end 16 of the hose 12 may be coupled to the bottle 24 for emptying water in the hose 12. The bottle 24 is then emptied when the user coupled the second end of the hose back to the faucet. The sheath 20 prevents any leakage from the device 10 should the valve 18 develop a leak.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An auxiliary valve device for placing an inlet pipe in communication with a faucet, said device comprising:

a hose having a first end and a second end, said first end comprising a threaded female coupler for fluidly coupling to the inlet pipe, said second end comprising a threaded female coupler for fluidly coupling to the faucet, said hose being flexible;

a valve being positioned between said first and second ends and being adapted for selectively opening and closing said hose.

2. The auxiliary valve device as in claim 1, further including:

a sheath being positioned around and generally enclosing said hose and said valve, said sheath being substantially waterproof.

3. The auxiliary valve device as in claim 1, further including:

a bottle having an open end having a male threaded coupler thereon adapted for threadably coupling to said second end of said hose.

4. An auxiliary valve device for placing an inlet pipe in communication with a faucet, said device comprising:

a hose having a first end and a second end, said first end comprising a threaded female coupler for fluidly coupling to the inlet pipe, said second end comprising a threaded female coupler for fluidly coupling to the faucet, said hose being flexible;

a valve being positioned between said first and second ends and being adapted for selectively opening and closing said hose;

a sheath being positioned around and generally enclosing said hose and said valve, said sheath being substantially waterproof; and a bottle having an open end having a male threaded coupler thereon adapted for threadably coupling to said second end of said hose.

5. An auxiliary valve system comprising:

a faucet;

an inlet pipe for supplying water to said faucet;

a hose for fluidly coupling said faucet to said inlet pipe, said hose having a first end and a second end, said first end comprising a threaded female coupler for fluidly coupling to the inlet pipe, said second end comprising a threaded female coupler for fluidly coupling to the faucet, said hose being flexible;

a valve being positioned between said first and second ends and being adapted for selectively opening and closing said hose;

a sheath being positioned around and generally enclosing said hose and said valve, said sheath being substantially waterproof; and a bottle having an open end having a male threaded coupler thereon adapted for threadably coupling to said second end of said hose.

* * * * *